United States Patent [19]

Turner

[11] 3,951,329

[45] Apr. 20, 1976

[54] TELESCOPE CONTAINER WITH RECESSED ENDS

[75] Inventor: Gerald W. Turner, Norristown, Pa.

[73] Assignee: Container Corporation of America, Chicago, Ill.

[22] Filed: Sept. 5, 1975

[21] Appl. No.: 610,572

[52] U.S. Cl. ..... 229/23 BT; 229/32

[51] Int. Cl.[2] ..... B65D 5/00; B65D 13/00

[58] Field of Search ..... 229/23 BT, 23 R, 37 E, 229/40, 32

[56] References Cited

UNITED STATES PATENTS

| | | | |
|---|---|---|---|
| 2,597,289 | 5/1952 | Caskey | 229/32 |
| 2,734,676 | 2/1956 | Lawrence | 229/23 R |
| 2,862,640 | 12/1958 | Somavia | 220/4 F |
| 3,132,792 | 5/1964 | Minion | 229/23 R |

FOREIGN PATENTS OR APPLICATIONS

| | | | |
|---|---|---|---|
| 6,600,448 | 7/1966 | Netherlands | 229/23 BT |
| 105,323 | 9/1966 | Denmark | 229/23 BT |

*Primary Examiner*—Davis T. Moorhead
*Attorney, Agent, or Firm*—Carpenter & Ostis

[57] ABSTRACT

A telescope container having recessed ends is formed of a pair of trays in telescoping relationship, each tray being formed from a cut and scored blank of paperboard or the like and having a rectangular panel with opposed side and end walls, the latter being spaced inward of the ends of the rectangular panel and being foldably connected thereto by a connector element in facing relationship with the main panel. Flaps are foldably connected between the side and end walls and are secured to maintain the end walls in position spaced from the ends of the main panel. One of the trays has the ends of the end walls spaced from the side walls and the flaps are folded to provide slots for the reception of the side walls of the other tray.

7 Claims, 7 Drawing Figures

TELESCOPE CONTAINER WITH RECESSED ENDS

BACKGROUND OF THE INVENTION

1. Scope of the Invention

The invention herein is primarily directed to mailers or shippers for books, so that "dog-earing" of the bindings thereof is prevented during shipping. By reason of the telescoping arrangement the container is adapted to receive books of varying thickness.

2. The Prior Art

Somavia U.S. Pat. No. 2,862,640, developed in a search, is illustrative of containers having interfitting side and end walls. It does not, however, teach a container formed from cut and scored blanks, nor is there any teaching of recessed end walls.

THE DRAWINGS

Figure 1:
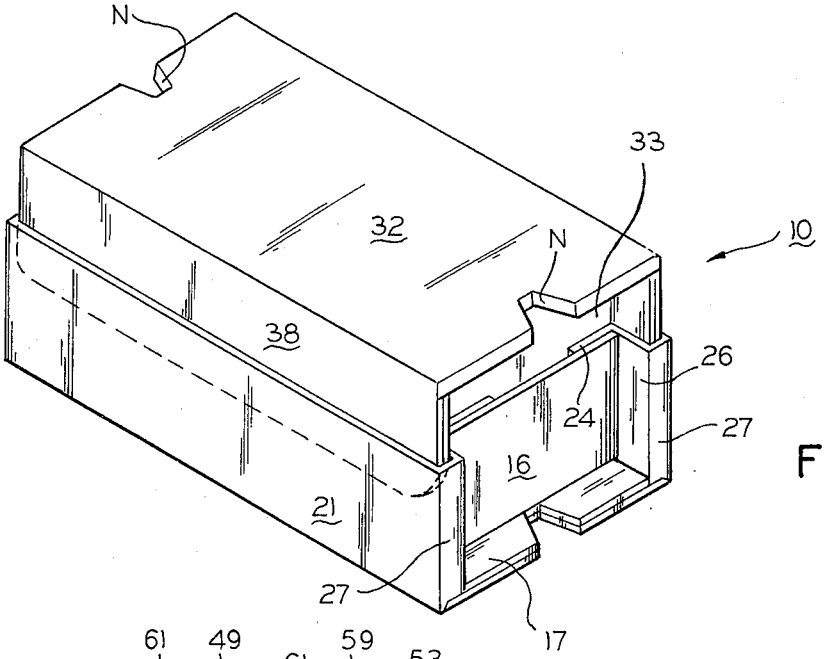
FIG. 1 is an isometric view of a telescope container according to the invention.
Figure 4:
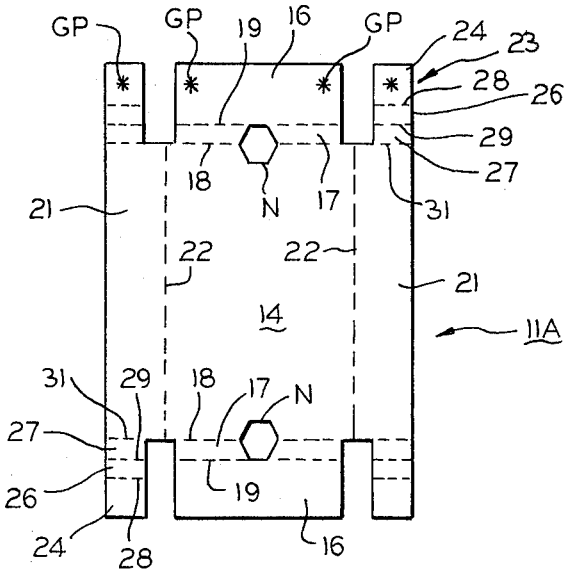
FIG. 4 is a plan view of a cut and scored blank for forming the tray of FIG. 3.
Figure 5:
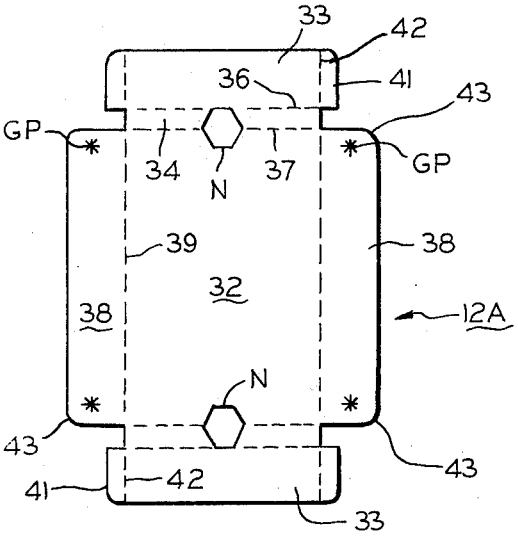
FIG. 5 is a plan view of a cut and scored blank for forming the tray of FIG. 2.
Figure 2:
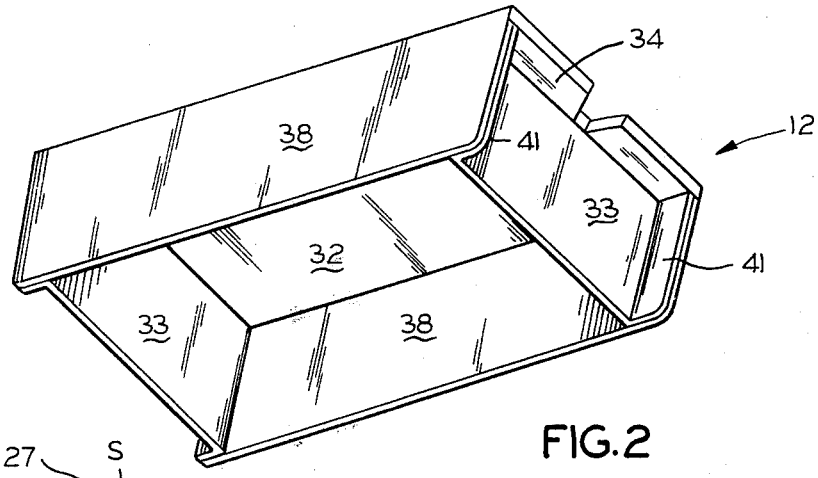
FIG. 2 is an isometric view of a top inverted tray for the container of FIG. 1.
Figure 3:
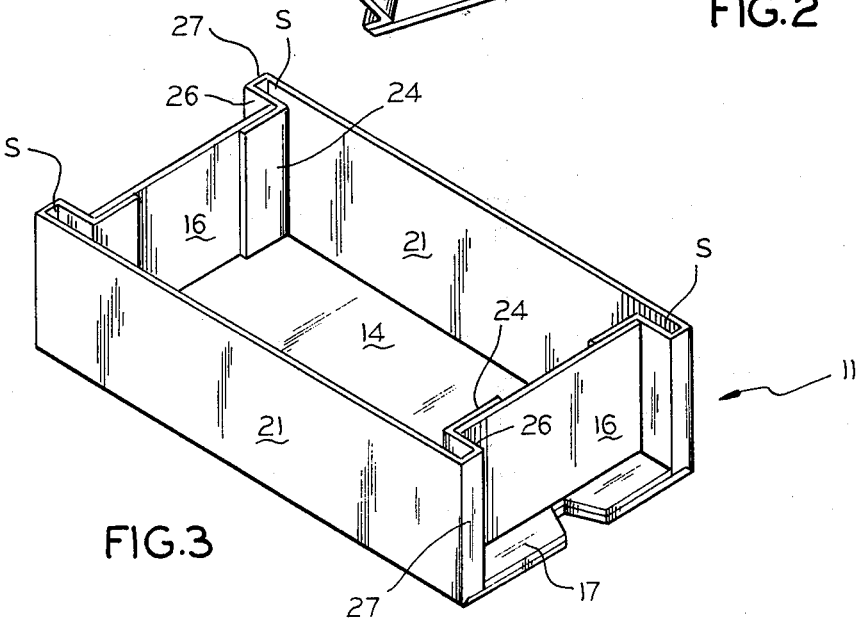
FIG. 3 is an isometric view of a bottom tray for the container of FIG. 1.

The improved telescope container having recessed ends is denoted by the reference numeral 10 as seen in FIG. 1, and is comprised of a lower tray 11 seen in FIG. 3 and an upper inverted or top tray 12 seen in FIG. 2. Bottom tray 11 is formed from a cut and scored blank 11A of paperboard or the like seen in FIG. 4, and upper inverted tray 12 is formed from a cut and scored blank 12A seen in FIG. 2.

Bottom tray blank 11A comprises a rectangular main panel 14 having opposed end walls 16 which when erected, are spaced inward of the ends of the main panel 14. A connector element 17 is foldably connected to main panel 14 in facing relationship therewith along a fold line 18, and is foldably connected along fold line 19 to the bottom of end wall 16.

Opposed side walls 21 are foldably connected to the sides of main panel 14 along fold lines 22, and flaps 23 are foldably connected between ends of the side and end walls 16 and 21 for maintaining the end walls 16 in position spaced from the ends of the main panel 14. Flaps 23 consist of a flap element 27 folded at right angles to side wall 21 along a fold line 31, a second flap element 26 folded into position parallel to side wall 21 along a fold line 29, and a third flap element 24 folded against the inside of end wall 16 along a fold line 28. The glue patches GP seen in FIG. 4 hold the elements described in position.

The structure thus far described results in a slot S at each corner of tray 11 for a purpose as will appear.

Upper inverted tray blank 12A for forming upper inverted tray 12 comprises a rectangular main panel 32 having opposed end walls 33, which when erected, are spaced from the ends of the main panel 32. A connector element 34 is foldably connected to panel 32 in facing relationship therewith along a fold line 37, and is foldably connected along fold line 36 to the end wall 33.

Opposed side walls 38 are foldably connected to main panel 32 along fold lines 39, and end wall 33 is secured to the side walls 38 by flaps 41 foldably connected to end walls 33 along fold lines 42. Walls 38 have glue patches GP thereon for securing flaps 41 thereto.

The dimensions of the trays 11 and 12 are such that they are nested with the ends of the side walls 38 fitting within the slots S of tray 11 as seen in FIG. 1.

The ends of the side walls 38 are rounded as at 43 to facilitate entrance thereof into the slots S.

Both trays 11 and 12 are provided with notches N at the ends thereof, so that when the container 10 is loaded, tape or strapping as desired may be wrapped therearound at the notches N.

By reason of the recessed end walls 16 and 33 of the nested trays 11 and 12 good protection is afforded to an article packed within container 10. Books are advantageously shipped in container 10, and the amount of telescoping of trays 11 and 12 is in accordance with book thickness.

Figure 6:
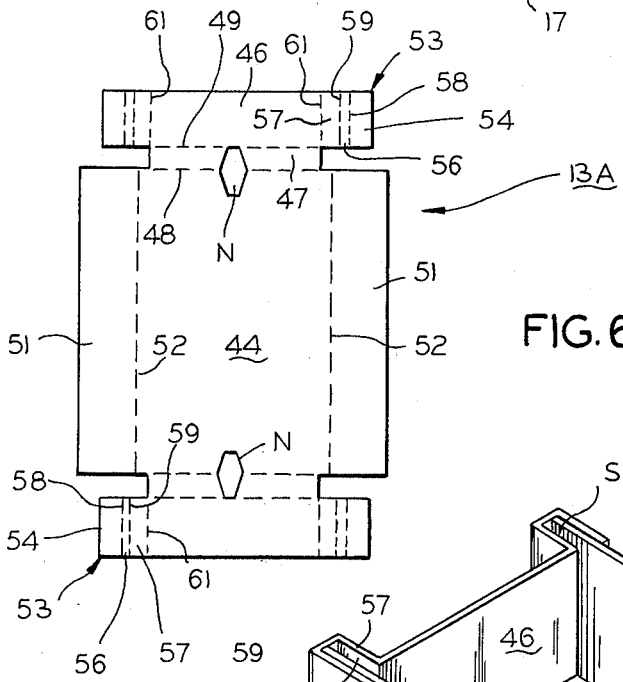
FIG. 6 is a plan view of a cut and scored blank for forming another embodiment of a bottom tray.
Figure 7:
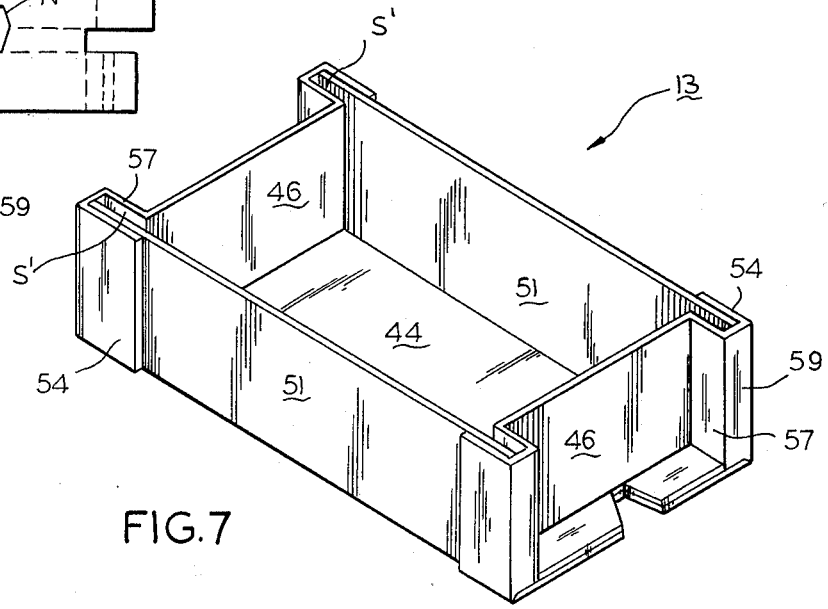
FIG. 7 is an isometric view of a tray formed by the blank of FIG. 6.

Referring now to FIGS. 6 and 7, there is shown another form of lower tray 13. Blank 13A for forming tray 13 comprises a rectangular main panel 44, recessed end walls 46 connected to main panel 44 by connector element 47 foldably connected at fold line 49 to end wall 46, and to main panel 44 at fold line 48.

Opposed side walls 51 are foldably connected to main panel 44 at fold lines 52, and end walls 46 are connected to the side walls 51 by flaps 53 extending from the ends of walls 46. Flaps 53 comprise flap elements 54, 56 and 57 foldably connected to each other along fold lines 58 and 59, flap element 57 being connected to wall 46 along fold line 61.

Flap elements 54, 56 and 57 are folded to define slots S′, flap element 54 being joined at the ends of side walls 51 by the usual glue patches, not shown. The side walls of upper tray 11 has the ends thereof held within the slots S′.

I claim:

1. A tray having a recessed end for forming one of a pair of telescoping trays for protecting the binding of a book or the like, said tray being formed from a cut and scored blank of paperboard or the like and comprising:

a. a rectangular main panel;

b. opposed end walls spaced inward of the ends of said main panel;

c. a connector element foldably connected to said main panel at each end thereof in facing relationship therewith and foldably connected to an end wall along an edge thereof;

d. opposed side walls foldably connected to said main panel along the sides thereof;

e. flaps foldably connected between ends of said side and end walls for maintaining said end walls in position spaced from the ends of said main panel to provide a recessed end for said tray.

2. A tray according to claim 1 wherein the ends of said ends walls terminate in spaced relationship to said side walls to provide with said flaps slots for the reception of the side walls of a tray having the end walls provided with wall tabs secured to the side walls of said last named tray.

3. A tray according to claim 1 wherein said tray has the ends of the side walls thereof provided with foldably connected flaps folded to position to provide a slot adjacent each end wall and its correlative side wall.

4. A telescope box having recessed ends and formed of a bottom tray and an inverted top tray in telescoping relationship with each other, said bottom and top trays being each formed from a cut and scored blank of paper board or the like and each comprising:

a. a rectangular main panel;

b. opposed end walls spaced inward of each end of said main wall;

c. a connector element foldably connected to said main panel in facing relationship therewith and foldably connected to an end wall along an edge thereof;

d. opposed side walls foldably connected to said main panel, along the sides thereof;

e. flaps foldably connected between ends of said side and end walls for maintaining said end walls in position spaced from the ends of said main panel to provide recessed ends for said trays.

5. A box according to claim 4 wherein one of said trays has the ends of the end walls thereof terminating in spaced relationship to said side walls to provide with said flaps slots for the reception of the ends of the side walls of the other tray therein.

6. A box according to claim 4 wherein the ends of said main panels and said connector elements are provided with notches for locating securing means wrapped about said trays when in telescoping relationship.

7. In a two piece telescoping container, the combination of:

a. a pair of upper and lower members each including a horizontal main wall and opposed pairs of vertical side and end walls inter-connected to form a tray-like structure;

b. each of said members having its end walls spaced inwardly from the end edges of said main wall and having end portions of its side walls extending beyond said end walls to the end edges of said main wall;

c. one of said members having the side edges of its end walls connected to the end edges of its side walls by connecting flange elements which are spaced inwardly from said side walls to provide spaces for receiving related end portions of the side walls of the other member when the members are brought together in telescoping relation.

* * * * *